US006670567B1

(12) United States Patent
Koseki et al.

(10) Patent No.: US 6,670,567 B1
(45) Date of Patent: Dec. 30, 2003

(54) ROTARY SWITCH MECHANISM FOR OPERATION PANEL

(75) Inventors: Akihiro Koseki, Konan (JP); Kazuhiko Hirota, Konan (JP); Hiroshi Misuda, Konan (JP)

(73) Assignee: Zexel Valeo Climate Control Corporation, Saitama (JP)

( * ) Notice: Subject to any disclaimer, the term of this patent is extended or adjusted under 35 U.S.C. 154(b) by 0 days.

(21) Appl. No.: 10/204,541

(22) PCT Filed: Oct. 24, 2000

(86) PCT No.: PCT/JP00/07418

§ 371 (c)(1),
(2), (4) Date: Aug. 22, 2002

(87) PCT Pub. No.: WO01/63632

PCT Pub. Date: Aug. 30, 2001

(30) Foreign Application Priority Data

Feb. 24, 2000 (JP) ..... 2000-047544

(51) Int. Cl.[7] ..... H04H 19/00

(52) U.S. Cl. ..... 200/564; 200/17 R; 200/573; 200/336

(58) Field of Search ..... 200/4, 5 R, 17 R, 200/18, 564, 568, 573, 574, 310–317, 336

(56) References Cited

U.S. PATENT DOCUMENTS 6,080,942 A * 6/2000 Sasaki ..... 200/17 R
6,084,369 A * 7/2000 Breitling ..... 318/549
6,087,607 A * 7/2000 Dohnal et al. ..... 200/574
6,512,189 B1 * 1/2003 Schuberth et al. ..... 200/334
6,534,730 B2 * 3/2003 Ohmoto et al. ..... 200/4

FOREIGN PATENT DOCUMENTS

JP 59-51423 3/1984 ..... H01H/19/18
JP 2000-164072 6/2000 ..... H01H/19/20

OTHER PUBLICATIONS

Microfilm of the specification and drawings annexed to the request of Japanese Utility Model Application No. 86133/1988 (Laid–open No. 8218/1990) (Pioneer Electronic Corporation) Jan. 19, 1990 p. 4, line 4 to p. 6, line 13; Figs. 1–5.

Microfilm of the specification and drawings annexed to the request of Japanese Utility Model Application No. 15650/1984 (Laid–open No. 129033/1985) (Komatsu Ltd.) Aug. 29, 1985 p. 3, line 7 to p. 6, line 16; Figs. 2, 3.

* cited by examiner

*Primary Examiner*—Michael Friedhofer
(74) *Attorney, Agent, or Firm*—Wenderoth, Lind & Ponack L.L.P.

(57) ABSTRACT

A rotary switch mechanism for an operation panel is designed such that the space on a printed board is ensured, the design of electronic parts on the printed board can be readily made, and the attachability of a switch is good. Drive pieces are arranged at predetermined intervals around the end of a rotary knob behind the operation panel, and a detection switch for detecting the passage and the direction of the passage of the drive pieces is disposed in or near the extent where the drive pieces move.

12 Claims, 9 Drawing Sheets

FIG.16 - PRIOR ART
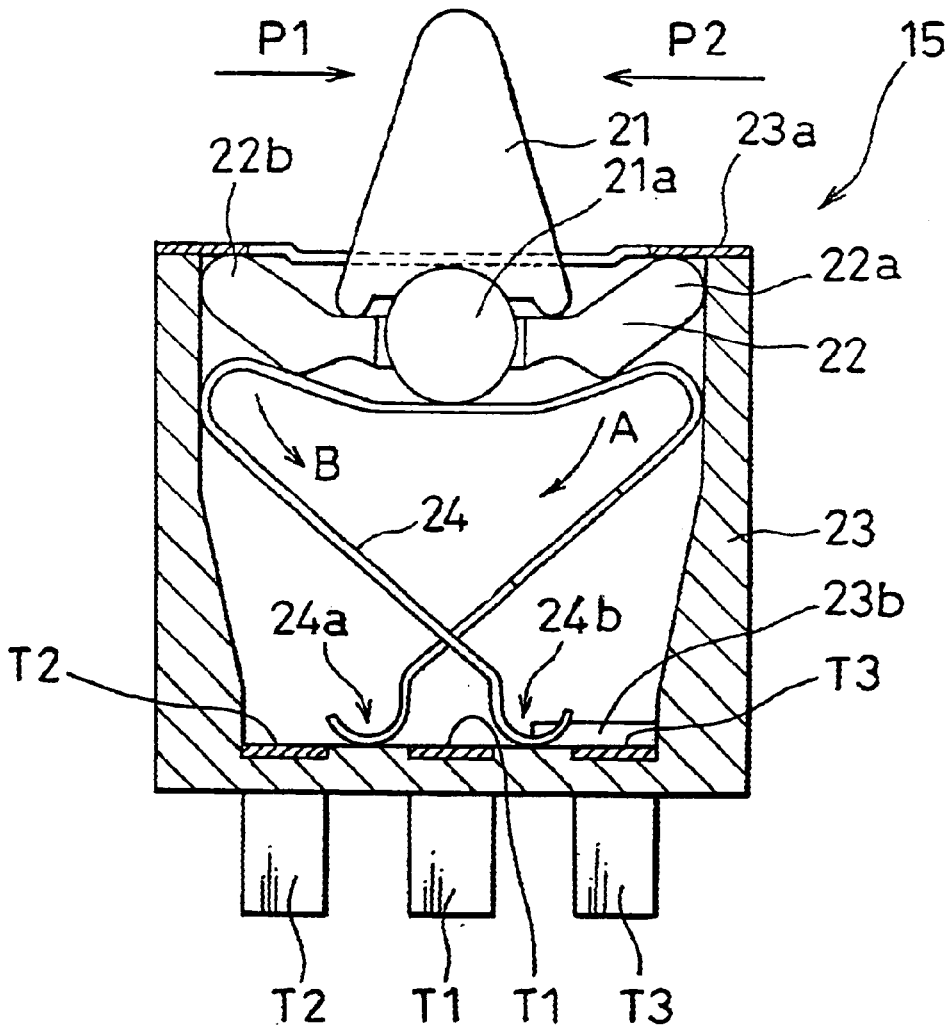

ROTARY SWITCH MECHANISM FOR OPERATION PANEL

TECHNICAL FIELD

The present invention relates to a rotary switch mechanism for an operation panel that may be utilized in, for instance, an air-conditioning system for vehicles.

BACKGROUND ART

A rotary switch in the related art disclosed in Japanese Unexamined Patent Publication No. H 9-288934 comprises a switch board having a plurality of switch contact points, an elastic pressure application plate that includes a plurality of arm units and holds contact portions provided at the individual arm units on the switch contact points and a rotating body that is rotatably provided on the switch board and includes depressing portions provided at the lower surface of the switch board to come in contact with the arm units and thus push down the arm units.

It is necessary to secure ample space in conjunction with a rotary switch utilized in an air-conditioning system for vehicles in the related art since push switches and the indicator light source are sometimes provided on the printed board where the contact points of the rotary switch are located. For this reason, a problem arises with regard to utilization of the rotary switch in the quoted reference above in that the space in which push switches, the indicator light source and the like can be provided becomes limited since a large area of the printed board is occupied by the contact points. In addition, since the knob of the rotary switch is firmly secured to the contact points, it is difficult to accurately align the position of the knob hole formed at the operation panel with the position of the knob secured to the printed board, which gives rise to a problem with regard to the installation at the printed board.

DISCLOSURE OF THE INVENTION

Accordingly, an object of the present invention is to provide a rotary switch mechanism for an operation panel that allows ample space on a printed board, facilitates the design process for designing electronic parts and the like on the printed board and achieves good attachability for the switch knob.

In order to achieve the object described above, according to the present invention, on an operation panel with a plurality of mode settings, which allows one of the plurality of mode settings to be selected by selecting one of the positions corresponding to the plurality of mode settings, a cylindrical rotary knob that includes a portion projecting out at the front surface of the operation panel and is capable of stopping at each of the positions corresponding to the plurality of mode settings, drive pieces formed at specific phases at the circumferential edge at the end of the rotary knob located further inward at the operation panel that move along the circumference of the rotary knob as the rotary knob rotates and a detection switch that detects a passage of and the direction of the passage of the drive pieces are provided.

Thus, with the present invention, which simply requires the drive pieces to be provided over specific intervals at the circumferential edge at the end of the rotary knob located further inward at the operation panel and the detection switch for detecting a passage of and the direction of the passage of the drive pieces to be provided within or in the vicinity of the range of the movement of the drive pieces, e.g., on the printed board, ample space is assured on the printed board, thereby solving the problem discussed earlier.

In addition, the drive pieces formed at the rotary knob may project out along the radius of the rotary knob or they may project out along the axial direction from the external circumferential edge at the end of the rotary knob. It is desirable that the detection switch be constituted of a physical detection switch having a movable piece that is capable of moving along a direction corresponding to the direction of the passage of the drive pieces, and such a movable piece may be set either parallel to the drive pieces or perpendicular to the drive pieces.

The present invention is further characterized in that an intermediate transmission mechanism that converts the intervals between the individual drive pieces to a distance required for the movement of the movable piece is provided between the drive pieces and the movable piece. For instance, if the rotary knob has a smaller diameter and thus the intervals between the drive pieces, too, are smaller, the movement of the movable piece at the detection switch over such a small distance between the drive pieces cannot be detected. In such a case, by providing the intermediate transmission mechanism, it becomes possible to allow the movable piece of the detection switch to move over a large enough distance to allow a detection thereof.

In addition, the intermediate transmission mechanism should comprise a first arm that is caused to move by the drive pieces, a second arm that causes the movable piece to move and a supporting point portion provided between the first arm and the second arm, with the length of the first arm and the length of the second arm set in correspondence to the ratio of the interval between the drive pieces and the distance required for the movement of the movable piece. The first arm and the second arm may be set on a single straight line, may be set perpendicular to each other or may be set at a specific angle to each other. The drive pieces may each be constituted of a tooth of a drive gear formed at the end of the rotary knob and the intermediate transmission mechanism may be constituted of a working gear which interlocks with the drive gear and rotates as the drive pieces move and a working portion that is secured to the working gear and rotates as the working gear rotates to cause the movable piece to move, with the ratio of the number of teeth of the drive gear and the number of teeth of the drive gear and the number of the working portions set in correspondence to the ratio of the pitch at the drive gear and the distance required for the movement of the movable piece.

Furthermore, the rotary switch mechanism may include a plurality of detection switches positioned at phases different from the phases of the drive pieces and the individual detection switches may sequentially detect the passage of and the direction of the passage of the drive pieces while the drive pieces move over a distance equivalent to the interval between the individual drive pieces. By adopting this structure, in which a plurality of detection switches are positioned at phases different from the phases of the drive pieces, the individual detection switches can sequentially detect the passage of and the direction of the passage of the drive pieces while the drive pieces move over the distance equivalent to the interval between the drive pieces, i.e., while they pass over a single pitch of the drive pieces and a desired number of signals representing the rotational angle of the rotary knob corresponding to the number of drive pieces can be generated even when the intervals between the individual drive pieces is set large enough to allow the required movement of the movable piece.

While the detection switch is constituted of a physical detection switch that detects the passage of and the direction of the passage of the drive pieces by detecting the movement of the working piece in the example described above, the detection switch according to the present invention may be constituted of an optical detection switch having a light emitting element and a light receiving element, which detects the passage of and the direction of the passage of the drive pieces by detecting a change of light while the drive pieces pass between the light emitting element and the light receiving element instead.

Moreover, if a light emitting source for the indicator unit is provided at the center of the rotary knob, only the light receiving element may be provided to detect the passage of and the direction of the passage of the drive pieces. In addition, the detection switch may take on any structure as long as it is capable of detecting the passage of and the direction of the passage of the drive pieces through detection of a change occurring in an electromagnetic wave, an acoustic wave, an electrical field, a magnetic field or the like instead of a change of a visible light beam as described above.

BRIEF DESCRIPTION OF THE DRAWINGS

FIG. 16 is a sectional view showing an example of a detection switch in the known art.

BEST MODE FOR CARRYING OUT THE INVENTION

The following is an explanation of the preferred embodiments of the present invention, given in reference to the drawings.

Figure 1:
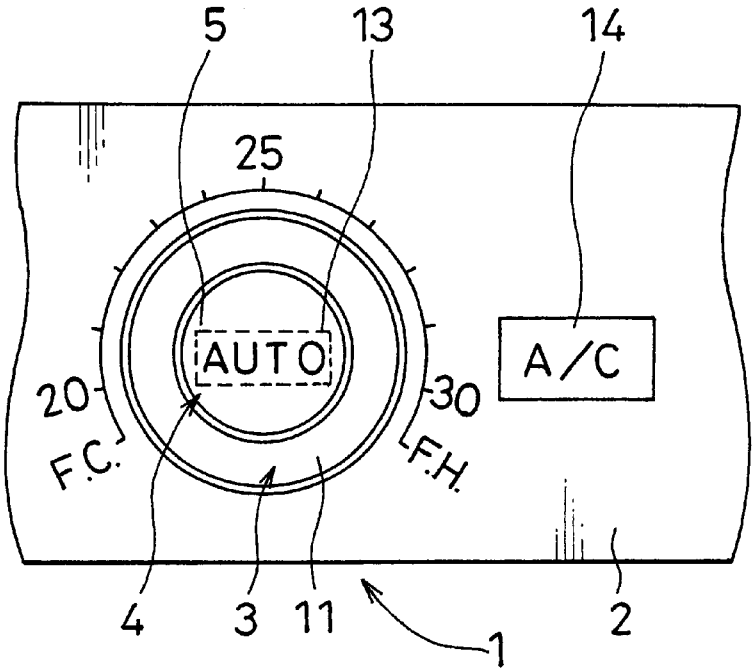
FIG. 1 is a partial front view of an example of an operation panel achieved in an embodiment of the present invention.
Figure 2:
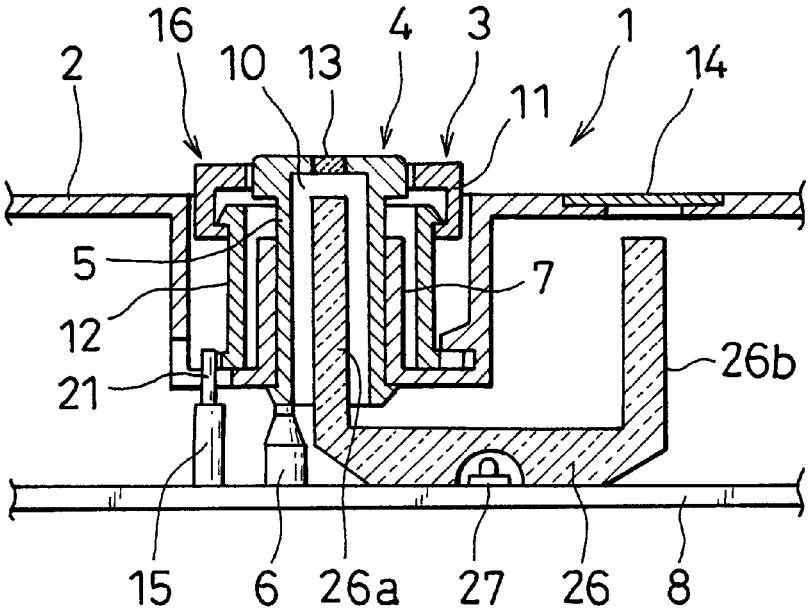
FIG. 2 is a sectional view of the operation panel shown in FIG. 1.

FIGS. 1 and 2 illustrate an example of an operation panel for an air-conditioning system. At this operation panel 1, a rotary switch mechanism 3 projecting out at the front surface of a case 2 and a push switch mechanism 4 located on the inside of a dial unit 11 of the rotary switch mechanism 3, for instance, are provided, with an indicator unit 13 provided at the center of the push switch mechanism 4. In addition, a light emitting indicator unit 14 is provided at the front surface of the case 2.

The push switch mechanism 4, which may be, for instance, an auto switch for turning on/off the air-conditioning system, comprises a push knob 5 slidably mounted at a cylindrical mounting portion 7 provided continuously to the case 2 and a push switch 6 provided on a printed board 8 that is in contact with the circumferential edge of the push knob 5 at the inner end, and a specific space 10 is formed within the push switch mechanism 4.

Figure 3:
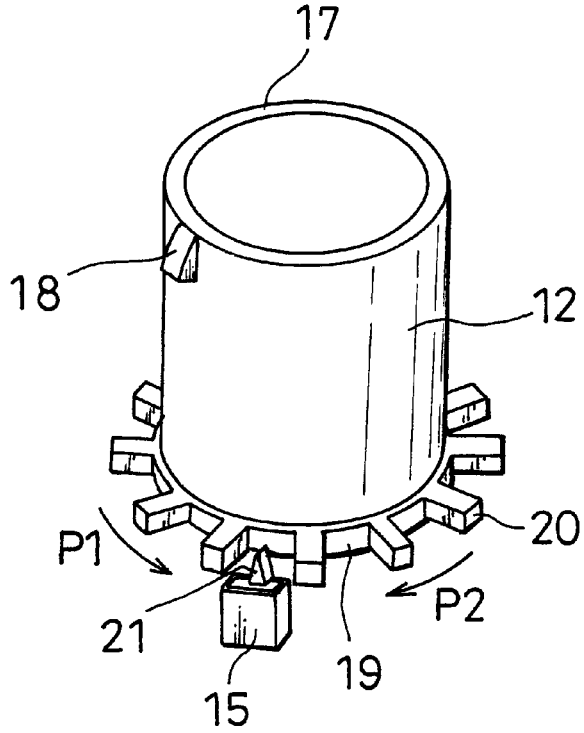
FIG. 3 is a perspective showing the cylindrical drive unit and the detection switch achieved in a first embodiment.

The rotary switch mechanism 3 comprises a rotary knob 16 constituted of the dial unit 11 projecting out at the surface of the case 2 and a cylindrical drive unit 12 interlocking with the dial unit 11, and a detection switch 15. In the first embodiment of the present invention, an interlocking piece 18 that interlocks with the dial unit 11 is formed at a circumferential edge 17, as shown in FIG. 3, at one end of the cylindrical drive unit 12, with drive pieces 20 which project out along the radius of the cylindrical drive unit 12 formed over a specific interval along the circumference at a circumferential edge 19 at the other end of the cylindrical drive unit 12.

The detection switch 15, which is a so-called bidirectional three-contact point switch of the known art, may comprise a movable piece 21 the front end of which moves around a shaft 21*a* along the direction in which the drive pieces 20 move as the drive pieces 20 pass while maintaining contact, a cam portion 22 that communicates the movement of the movable piece 21, a switch spring 24 that causes contact points 24*a* and 24*b* formed at the front end thereof as the cam portion 22 moves, contact points T1, T2 and T3 formed at the surface against which the contact points 24*a* and 24*b* slide, a case 23 at which the contact points T1, T2 and T3 are provided with the cam portion 22 and the switch spring 24 housed therein and the shaft 21*a* rotatably fixed thereto and a lid portion 23*a* that includes an opening through which the drive pieces 20 project out and hold arms 22*a* and 22*b* of the cam portion 22.

In the structure described above, the movable piece 21 is pushed down along direction P1 as the drive pieces 20 travel along direction P1 and, as a result, the arm 22*a* of the cam portion 22 causes the switch spring 24 to move along direction A. Thus, the terminal 24*a* comes in contact with the contact point T2 and the terminal 24*b* comes in contact with the contact point T1, thereby setting the terminals T1 and T2 in a state of contact. However, since the movable piece 21 becomes reset to its original position after one of the drive pieces 20 passes over, the switch spring 24, too, returns to its original position, thereby cutting off the terminals T1 and T2 from each other again. In this manner, when the drive pieces 20 move along direction P1 by one unit of pitch a single signal is generated at the T2 terminal. Likewise, when the drive pieces 20 move along direction P2 by one unit of pitch, the switch spring 24 moves along direction B and then returns to its original position to set the terminals T1 and T3 in a state of contact, thereby generating a single signal at the T3 terminal.

Thus, when the driver rotates the dial unit 11 over a specific range, a specific number of drive pieces 20 sequentially pass over the detection switch 15 causing the movable piece 21 to move the specific number of times, which, in turn, causes the detection switch 15 to output the specific number of signals indicating the direction of the passage of the drive pieces. More specifically assuming that the drive pieces 20 are formed over intervals each corresponding to a 0.5° C. increment at the operation panel 1 in FIG. 1, for instance, if the dial unit 11 is rotated to change the temperature setting from 25° C. to 28° C., the contact point T1 and the contact point T3 that achieve contact when the temperature setting is raised (e.g., along direction P2) enter a state of contact six times at the detection switch 15, thereby generating six signals indicating direction P2 at the terminal T3 to allow the driver to verify that the temperature setting has been changed from 25° C. to 28° C. Likewise, when the temperature setting has been lowered from 28° C. to 24° C., the contact point T1 and the contact point T2 that achieve contact when lowering the temperature setting (e.g., along direction P1) enter a contact state eight times thereby generating eight signals indicating direction P1 at the terminal T2 and making it possible to verify that the temperature setting has been changed from 28° C. to 24° C.

In addition, as illustrated in FIG. 2, adequate space for accommodating the push switch mechanism 4 is assured on the inside by employing the rotary switch mechanism 3 achieved in the first embodiment, and consequently, one of the light paths, i.e., a light path 26*a* of a light guide 26 can be housed within the push switch mechanism 4, and the space for accommodating the light source for the indicator 13 of the push switch mechanism 4 can be assured with ease. Furthermore, since the drive pieces 20 of the rotary knob 16 and the movable piece 21 of the detection switch 15 are not fixed to each other in this embodiment, the function of the detection switch 15 is not compromised as long as the movable piece 21 is set intersecting the rotational range of the drive pieces 20 even if a slight dimensional misalignment occurs during the mounting process, and thus, the mounting process can be simplified. It is to be noted that reference numeral 26*b* indicates a light path through which light is provided to the indicator unit 14 and reference numeral 27 indicates a light bulb constituting a light source provided on the printed board 8. While a light bulb is utilized as the light source in this embodiment, a light emitting diode may instead be employed.

Figure 4:
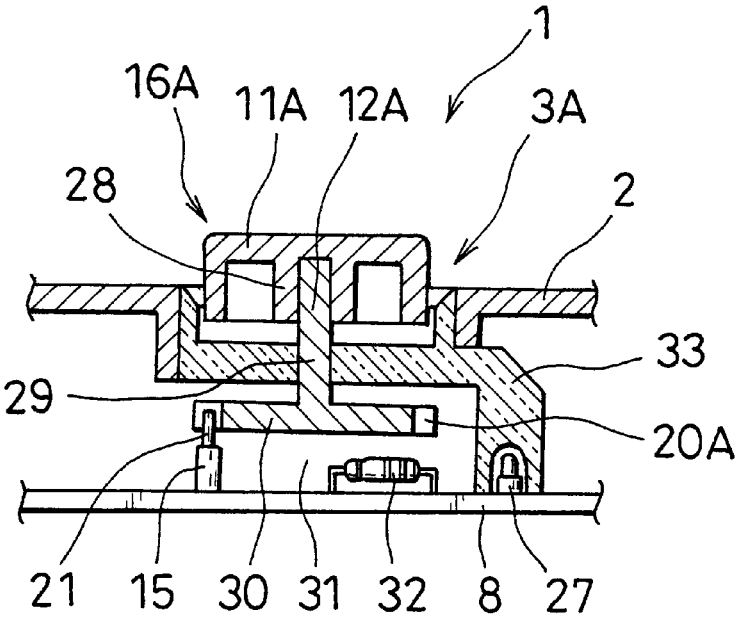
FIG. 4 is a sectional view of the operation panel achieved in a second embodiment.

In the second embodiment shown in FIG. 4, a rotary knob 16A in a rotary switch mechanism 3A comprises a dial unit 11A projecting out from the case 2, a rod unit 29 mounted at a cylindrical fitting portion 28 provided at the center of the dial unit 11A and a disk unit 30 provided at an end of the rod unit 29. Drive pieces 20A extending along the radius of the disk unit 30 are formed over specific intervals around the disk unit 30 to cause a movement of a movable piece 21 of the detection switch 15. It is to be noted that in this embodiment and subsequent embodiments, the same reference numerals are assigned to components identical to or components achieving identical effects to those in the embodiment described above to preclude the necessity for a repeated explanation thereof.

Since this structure allows a specific space 31 to be secured between the rotary knob 16A and the printed board 8, an electronic part 32, which may be a resistor, a capacitor or an IC, can be accommodated adjacent a light path 33 which guides the light from the light bulb 27 to achieve a light emission at the circumferential edge of the dial unit 11A.

Figure 5:
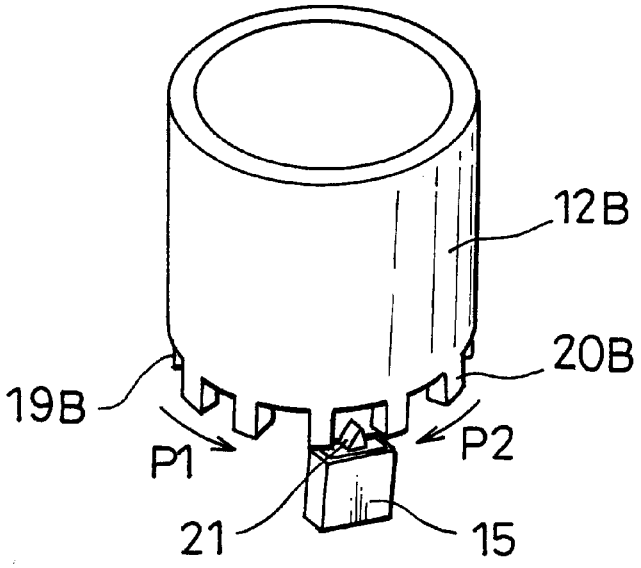
FIG. 5 is a perspective showing the cylindrical drive unit and the detection switch achieved in a third embodiment.

At a cylindrical drive unit 12B in the third embodiment illustrated in FIG. 5, drive pieces 20B are formed so as to project out along the axis of the cylindrical drive unit 12B over a specific interval along the circumference from a circumferential edge 19B at the other end of the cylindrical drive unit 12B. Since the drive pieces 20B do not project out along the radial direction in this embodiment, there is a likelihood of the measurement along the axial direction being greater than in the previous embodiments. However, a space is assured at the circumferential edge of the cylindrical drive unit 12B along the radial direction.

Figure 6:
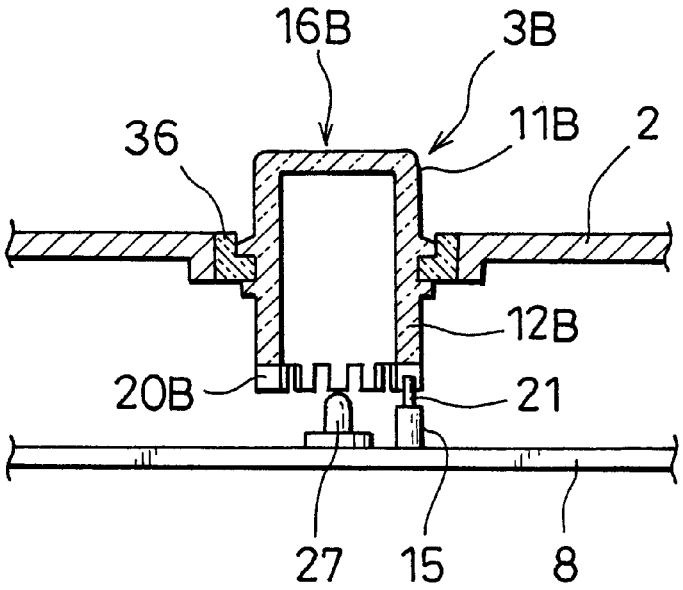
FIG. 6 is a sectional view of the operation panel achieved in the third embodiment.

A rotary switch mechanism 3B shown in FIG. 6 includes a rotary knob 16B achieved by forming a dial unit 11B and the cylindrical drive unit 12B in the third embodiment and as an integrated unit with a light source 27 provided on the printed board 8 at the center of the rotary knob 16B. In addition, the rotary knob 16B in the embodiment is constituted of a transparent resin, a colored transparent resin or a colored opaque resin such as a milk-white resin, and a light emission is achieved at the rotary knob 16B itself by utilizing the light source 27. A ring 36 constituted of a transparent resin, a colored transparent resin or a colored opaque resin such as a milk-white resin taking on a color different from the color of the rotary knob 16B is provided at the external circumference of the rotary knob 16B. This structure allows a plurality of indications to be produced with a single light source. It is to be noted that while the cylindrical drive unit 12B and the rotary knob 16B are formed as an integrated unit in the third embodiment, they may be formed as separate parts and then may be integrated with each other through fitting or the like, instead.

Figure 7:
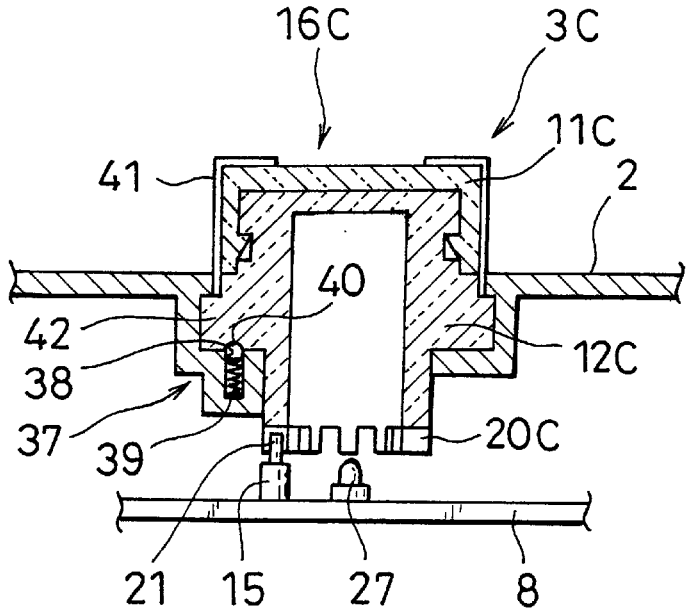
FIG. 7 is a sectional view of the operation panel achieved in a fourth embodiment.

In a rotary switch mechanism 3C in the fourth embodiment shown in FIG. 7 which is achieved by modifying the cylindrical drive unit 12B in the third embodiment, a flange portion 42 distends outward along the radial direction from a specific position at the cylindrical drive unit 12C, a groove portion 40 running along the flange portion 42 is formed at the lower side surface of the flange portion 42, a part of the groove portion 40 has a greater depth for positioning purposes and the position is set as a ball 38 of a click mechanism 37 goes into the deeper part. This position corresponds to a position of the drive pieces 20C. It is to be noted that while the click mechanism in the embodiment is constituted of the ball 38 pressed into the groove portion 40 by a spring 39, the click mechanism may instead be constituted of a plate spring, for instance. In addition, the dial unit 11C in the embodiment is constituted as a part separate from the cylindrical drive unit. 12C by using a transparent resin or the like and a film 41 for blocking light is formed over the area where it is not necessary to emit light to ensure that light is emitted only where needed.

Figure 8:
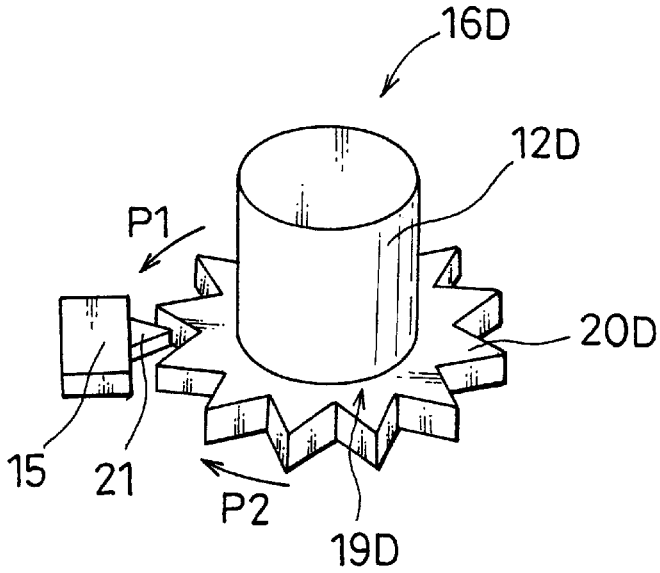
FIG. 8 is a perspective showing the cylindrical drive unit and the detection switch achieved in a fifth embodiment.

In the fifth embodiment shown in FIG. 8, drive pieces 20D at a circumferential edge 19D at the other end of a cylindrical drive unit 12D constituting a rotary knob 16D are formed as gear teeth and the detection switch 15 is provided along the radial direction. Since the detection switch 15 is provided along the radial direction in this case, adequate space is assured along the axial direction.

Figure 9:
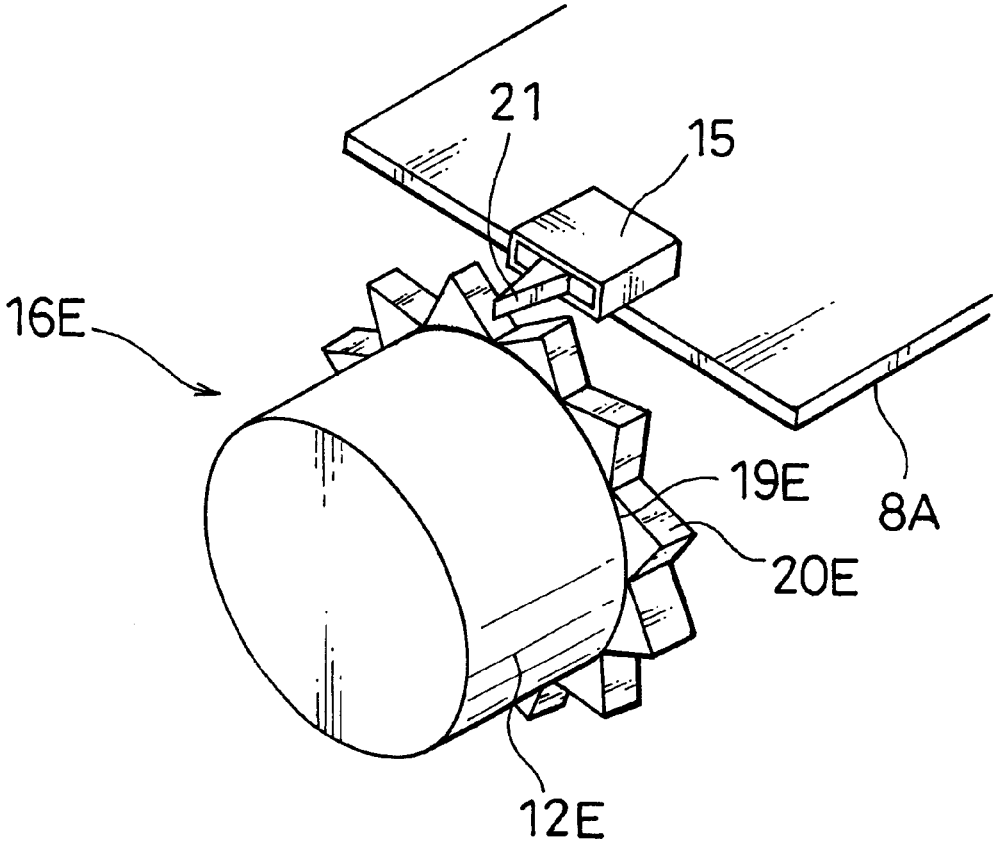
FIG. 9 is a perspective showing the cylindrical drive unit and the detection switch achieved in a sixth embodiment.

In the sixth embodiment shown in FIG. 9, drive pieces 20E at a circumferential edge 19E at the other end of a cylindrical drive unit 12E constituting a rotary knob 16E are formed as gear teeth and the detection switch 15 is provided on a sub-printed board 8A set perpendicular to the main printed board 8 shown in the figures referred to earlier. Since this allows the detection switch 15 to be mounted at any position as long as it is provided in the vicinity of the cylindrical drive unit 12E, a higher degree of freedom is afforded in design.

Figure 10:
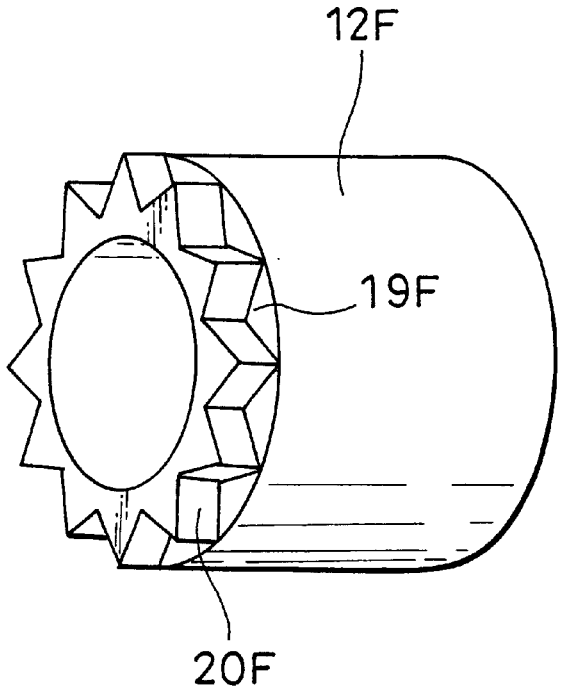
FIG. 10 is a perspective showing the cylindrical drive unit achieved in a seventh embodiment.

In the seventh embodiment shown in FIG. 10, drive pieces 20F formed as gear teeth at a circumferential edge 19F at the other end of a cylindrical drive unit 12F are set within the range of the bottom surface of the cylindrical drive unit 12F. By adopting this structure, the measurement along the radial direction is reduced compared to those in the fifth and sixth embodiments shown in FIGS. 8 and 9 respectively.

Figure 11:
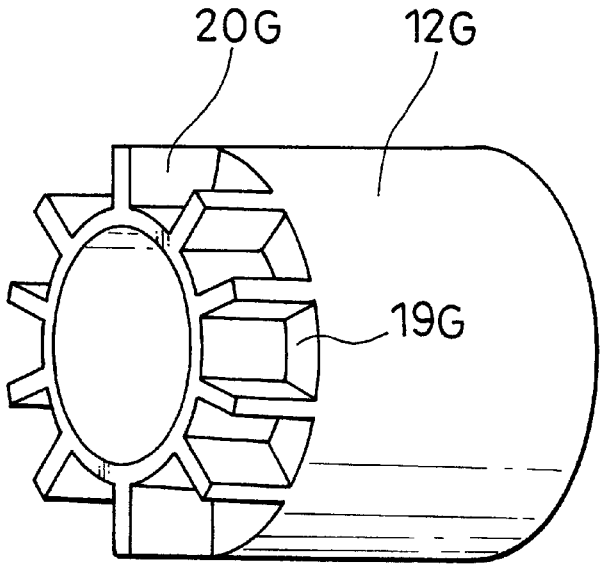
FIG. 11 is a perspective showing the cylindrical drive unit achieved in an eighth embodiment.

In the eighth embodiment shown in FIG. 11, plate like drive pieces 20G at a circumferential edge 19G at the other end of a cylindrical drive unit 12G are formed within the range of the bottom surface of the cylindrical drive unit 12G. In this case, too, the measurement along the radial direction can be reduced compared to those in the fifth and sixth embodiments shown in FIGS. 8 and 9 respectively, as in the seventh embodiment shown in FIG. 10.

Figure 12:
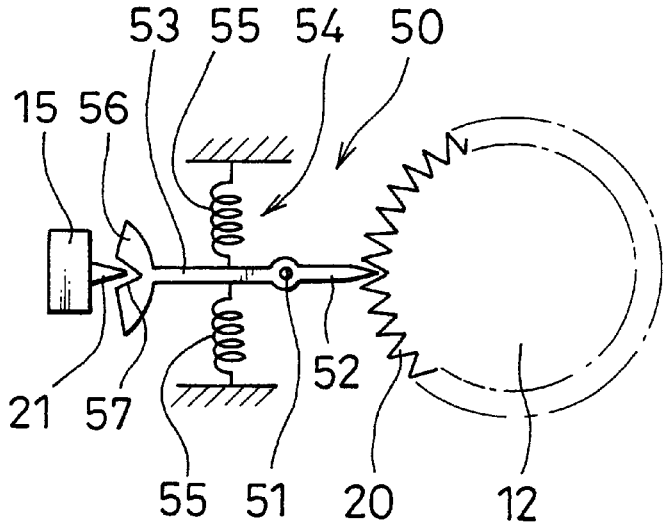
FIG. 12 illustrates the intermediate transmission unit achieved in a ninth embodiment.

In the ninth embodiment shown in FIG. 12, an intermediate transmission mechanism 50 is provided between the drive pieces 20 and the movable piece 21 in a structure in which the pitch of the drive pieces 20 formed at the cylindrical drive unit 12 constituting the rotary knob 16 is not large enough to allow the required movement of the movable piece 21 at the detection switch 15, i.e., in a structure in which the rotary knob 16 has a small radius.

The intermediate transmission mechanism 50 comprises a first arm 52 and a second arm 53 provided on the two opposite sides of a rotational support point 51 and a spring 55 constituting a holding mechanism 54 that holds the first and second arms 52 and 53 at specific positions. In addition, the front end of the first arm 52 is caused to move by the drive pieces 20, whereas a working portion 56 that moves the movable piece 21 is provided at the front end of the second arm 53. The working portion 56 includes an interlocking groove 57 that interlocks with the movable piece 21 and its side surface toward the detection switch 15 is formed in an arc extending over a specific length so as to ensure that the movable piece 21 is not allowed to disengage from the working portion 56. In addition, the ratio of the length L1 of the first arm 52 and the length L2 of the second arm 53 should be set equal to or slightly larger than the ratio of the pitch P1 of the drive pieces 20 and the operating pitch P2 of the movable piece 21 ($L1/L2 \geqq P1/P2$).

Under normal circumstances, the cylindrical drive unit 12 needs to have a minimum diameter of 46 mm to generate a single ON signal in correspondence to a rotational angle of 10° by which the cylindrical drive unit 12 is rotated since the movable piece 21 at the detection switch 15 requires an operating distance of 4 mm. However, if the diameter of the cylindrical drive unit 12 is smaller than 46 mm, e.g., 23 mm, the pitch of the drive pieces 20 is 2 mm and, accordingly, by setting the ratio of the lengths of the first and second arms 52 and 53 at the intermediate transmission, mechanism 50 equal to or larger than 1:2, the operating pitch P2 of the detection switch 15 can be set equal to or larger than 4 mm, and thus, an ON signal can be generated at the detection switch 15 in correspondence to the rotational range of 10° over which the cylindrical drive unit 12 is rotated.

Figure 13:
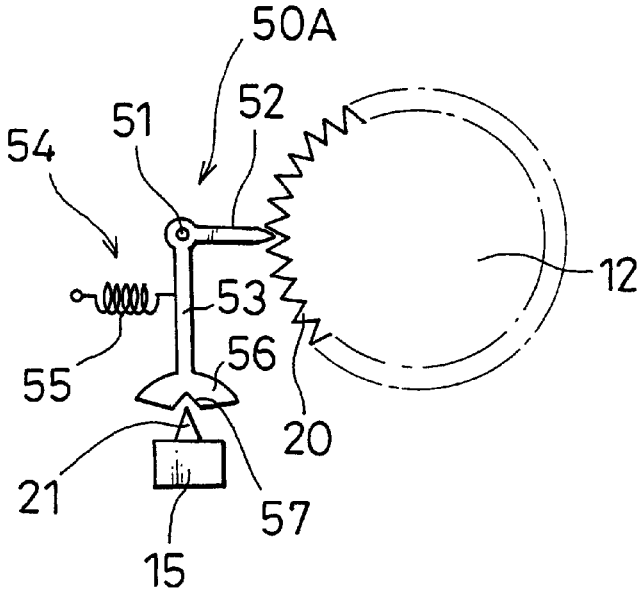
FIG. 13 illustrates the intermediate transmission unit achieved in a tenth embodiment.

In addition, while the first arm 52 and the second arm 53 in the intermediate transmission mechanism 50 achieved in the ninth embodiment shown in FIG. 12 are provided on a single straight line and the detection switch 15 is provided on an extension of the straight line, the first arm 52 and the second arm 53 in the tenth embodiment shown in FIG. 13 are set perpendicular to each other extending from the rotational support point 51, with the detection switch 15 provided at a position different from that assumed in the ninth embodiment. While the detection switch 15 is provided along the perpendicular direction in the embodiment, the position of the detection switch 15 can be varied freely by setting the second arm 53 at a specific angle relative to the position of the first arm 52.

Figure 14:
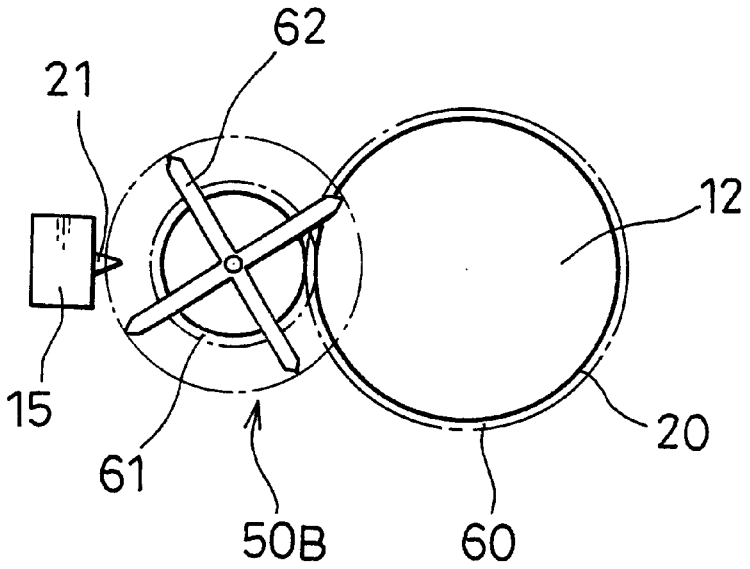
FIG. 14 illustrates the intermediate transmission unit achieved in an eleventh embodiment.

In the eleventh embodiment shown in FIG. 14, the drive pieces 20 are constituted of the teeth of a drive gear 60 formed at the cylindrical drive unit 12, and an intermediate transmission mechanism 50B is constituted of a working gear 61 that interlocks with the drive gear 60 and at least one working portion 62 that rotates together with the working gear 61.

To explain the embodiment by assuming that four working portions 62 are formed over a uniform interval, if one ON signal is to be output through the detection switch 15 in correspondence to a rotational angle of 10° by which the cylindrical drive unit 12 is rotated, the ratio of the radius of the drive gear 60 and the radius of the working gear 61 and the gear ratio need to be set to 9:1 as there are four working portions 62. In addition, since the ratio of the radii and the gear ratio can be reduced by increasing the number of working portions 62, the ratio of the radius of the drive gear 60 and the radius of the working gear 61 and the gear ratio should be adjusted by taking into consideration the pitch of the working portions 62 to achieve further versatility.

As explained above, when the cylindrical drive unit 12 has a smaller diameter, the pitch of the drive pieces 20 becomes smaller than the operating pitch of the movable piece 21, and accordingly, the angle (phase) $\alpha 1$ of the drive pieces 20 formed around the cylindrical drive unit 12 is set larger than the minimum angle requirement (phase) and detection switches 15 are each provided at a phase $\alpha 2$ which is different from the phase $\alpha 1$ in the twelfth embodiment so as to allow the individual detection switches 15 to sequentially output signals when the drive pieces 20 move over a specific range.

Figure 15:
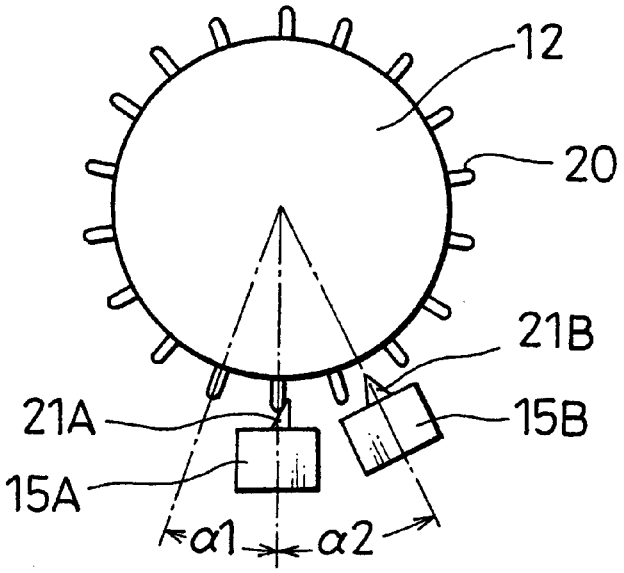
FIG. 15 illustrates the cylindrical drive unit, the first detection switch and the second detection switch achieved in a twelfth embodiment.

For instance, if the angle (phase) $\alpha 1$ formed by adjacent drive pieces 20 is 20° as shown in FIG. 15 and two detection switches are provided in conjunction with this structure, the angle (phase) $\alpha 2$ formed by a movable piece 21A of a first detection switch 15A and a movable piece of 21B of a second detection switch 15B is set through a formula; 20n+C (C=10). In more specific terms, the position of the second detection switch 15B is set at a position at a 30° phase, a 50° phase, a 70° phase . . . or a 330° phase relative to the position of the first detection switch 15A. Thus, if the drive pieces 20 move by 10°, the drive pieces 20 cause either the movable piece 21A or the movable piece 21 B of the first detection switch 15A or the second detection switch 15B to move, and when the drive pieces 20 move by another 10°, the other movable piece 21A or 2 1B is caused to move. As a result, even though the drive pieces 20 are set over 20° intervals, the first detection switch 15A and the second detection switch 15B each output a signal as the cylindrical drive unit 12 is rotated by 20° and, consequently, two signals are obtained in correspondence to a 20° rotation of the cylindrical drive unit 12. If, on the other hand, the drive pieces 20 are each set at a 30° phase, a second detection switch should be provided at a 30n+10 phase and a third detection switch should be provided at a 30n+20 phase relative to the position of a first detection switch, to obtain a signal in correspondence to every 10° rotation of the cylindrical drive unit 12 even though the drive pieces 20 are formed over 30° intervals.

By forming the drive pieces 20 over a distance from each other that allows the minimum operating pitch (approximately 4 mm) for the movable pieces 21 and providing the plurality of detection switches 15 at specific phases (central angles) different from the phases (central angles) of the drive pieces 20, as described above, an ON signal can be obtained through one of the detection switches in correspondence to a specific angle by which the rotary knob 16 is rotated. Thus, with al representing the phase of the drive pieces 20 and M representing the number of detection switches provided, the phase $\alpha 2$ at which an Fth detection switch should be set can be determined through the following formula (1). It is to be noted that n is a natural number and $0<\alpha 2<360$.

$$\alpha 2=n\cdot\alpha 1+F(\alpha 1/M) \quad (1)$$

While the detection switch 15 is constituted of a physical detection switch that detects the passage of the drive pieces in the structures described above, the detection switches in the embodiments may each be constituted of an optical detection switch having a light emitting element and a light receiving element, which detects the passage of and the direction of the passage of the drive pieces by detecting a change of light manifesting while the drive pieces pass between the light emitting element and the light receiving element, instead. Moreover, if a light emitting source for the indicator unit is provided at the center of the rotary knob, only the light receiving element may be provided to detect the passage of and the direction of the passage of the drive pieces. In addition, a detection switch utilized in the present invention may take on any structure as long as it is capable of detecting the passage of and the direction of the passage of the drive pieces through detection of a change occurring in an electromagnetic wave, an acoustic wave or the like instead of a change of a visible light beam described above. However, at present, it is most desirable to utilize physical detection switches since they are the least costly.

INDUSTRIAL APPLICABILITY

As explained above, according to the present invention in which the passage of and the direction of the passage of drive pieces formed over specific intervals at the circumferential edge of a rotary knob at one end further inward at an operation panel are detected by utilizing a detection switch, the detection switch needs only to be provided within the range of movement of the drive pieces or in the vicinity of the range of their movement, e.g., on a printed board, and thus, ample space is assured on the printed board to improve the degree of freedom with regard to the layout of the parts on the printed board. Since this allows the path of light emitted from the light source on the printed board to be designed with freedom, the degree of design freedom is further improved.

In addition, since the drive pieces at the rotary knob and the movable piece of the detection switch are not fixed to each other, it is not necessary to align the rotary knob with the detection switch with absolute precision, and thus, the rotary switch mechanism can be mounted with ease. Moreover, since the detection switch can be constituted of an inexpensive switch, the production cost can be reduced.

What is claimed is:

1. A rotary switch mechanism for an operation panel with a plurality of mode settings which allows one of the plurality of mode settings to be selected by selecting one of positions corresponding to the plurality of mode settings, characterized by comprising:

a cylindrical rotary knob that includes a portion projecting out at the front surface of said operation panel and is capable of stopping at each of the positions corresponding to the plurality of mode settings;

drive pieces formed at specific phases at a circumferential edge at an end of said rotary knob located further inward at said operation panel that move along the circumference of said rotary knob as said rotary knob rotates, and a plurality of detection switches provided at phase different from the phrase at which said drive pieces are provided.

wherein each of said detection switches sequentially detects the passage of and the direction of passage of said drive pieces while said drive pieces move over a distance equivalent to the distance between said drive pieces.

2. A rotary switch mechanism for an operation panel according to claim 1, characterized in that:

said drive pieces formed at said rotary knob project out along the radius of said rotary knob.

3. A rotary switch mechanism for an operation panel according to claim 2, characterized in that:

said detection switches each include a movable piece capable of moving along a direction corresponding to the direction of the passage as said drive pieces pass, and said movable piece extends outward along a direction matching the direction in which said drive pieces extend.

4. A rotary switch mechanism for an operation panel according to claim 3, characterized in that:

an intermediate communication transmission mechanism that converts the distance between said drive pieces to a distance required for the movement of said movable piece is provided between said drive pieces and said movable piece.

5. A rotary switch mechanism for an operation panel according to claim 4, characterized in that:

said intermediate transmission mechanism comprises:

a first arm that is caused to move by said drive pieces;

a second arm that causes said movable piece to move; and a supporting point portion provided between said first arm and said second arm, with the length of said first arm and the length of said second arm set in correspondence to a ratio of an interval between said drive pieces and a distance required for the movement of said movable piece.

6. A rotary switch mechanism for an operation panel according to claim 4, characterized in that:

said drive pieces are each constituted of a tooth of a drive gear formed at the end of said rotary knob;

said intermediate transmission mechanism is constituted of a working gear which interlocks with said drive gear and rotates as said drive pieces move and a working portion that is secured to the working gear and rotates as the working gear rotates to cause said movable piece to move; and a ratio of a number of teeth of said drive gear and a number of teeth of the drive gear and the number of working portions set in correspondence to a rate of a pitch at said drive gear and the distance required for a movement of said movable piece.

7. A rotary switch mechanism for an operation panel according to claim 2, characterized in that:

said detection switches each include a movable piece capable of moving along a direction corresponding to the direction of the passage as said drive pieces pass and said movable piece extends outward perpendicular to the direction in which said drive pieces extend.

8. A rotary switch mechanism for an operation panel according to claim 7, characterized in that:

an intermediate communication transmission mechanism that converts the distance between said drive pieces to a distance required for the movement of said movable piece is provided between said drive pieces and said movable piece.

9. A rotary switch mechanism for an operation panel according to claim 1, characterized in that:

said drive pieces formed at said rotary knob project out along the axial direction from an external circumferential edge at the end of said rotary knob.

10. A rotary switch mechanism for an operation panel according to claim 9, characterized in that:

said detection switches each include a movable piece capable of moving along a direction corresponding to the direction of the passage as said drive pieces pass, and said movable piece extends outward along a direction matching the direction in which said drive pieces extend.

11. A rotary switch mechanism for an operation panel according to claim 9, characterized in that:

said detection switch each include a movable piece capable of moving along a direction corresponding to the direction of the passage as said drive pieces pass and said movable piece extends outward perpendicular to the direction in which said drive pieces extend.

12. A rotary switch mechanism for an operation panel according to any of claims 1 through 7, characterized in that:

said rotary switch mechanism includes a plurality of detection switches positioned at phases different from phases of said drive pieces and said detection switches sequentially detect the passage of and the direction of the passage of said drive pieces while said drive pieces move over a distance equivalent to a interval between said drive pieces.

* * * * *